US006721519B2

(12) United States Patent
Brown

(10) Patent No.: US 6,721,519 B2
(45) Date of Patent: Apr. 13, 2004

(54) PERFORMANCE SENSING CLEANING DEVICE

(75) Inventor: Kenneth J. Brown, Rochester, NY (US)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 10/080,009

(22) Filed: Feb. 21, 2002

(65) Prior Publication Data

US 2003/0044206 A1 Mar. 6, 2003

Related U.S. Application Data

(60) Provisional application No. 60/317,392, filed on Sep. 5, 2001.

(51) Int. Cl.[7] ..... G03G 21/00

(52) U.S. Cl. ..... 399/71; 399/353; 399/354

(58) Field of Search ..... 399/66, 71, 101, 399/297, 343, 345, 353, 354, 358, 360

(56) References Cited

U.S. PATENT DOCUMENTS 5,546,177 A * 8/1996 Thayer ..... 399/353
5,652,945 A * 7/1997 Thayer et al. ..... 399/354 X
5,903,797 A * 5/1999 Daniels et al. ..... 399/71 X

* cited by examiner

*Primary Examiner*—William J. Royer

(57) ABSTRACT

A cleaner for removing contaminates. Sensors detect a position of the cleaner with respect to a substrate, a proper rotation of components within the cleaner, and a proper electrical bias of the components. The components include a fiber brush, a detoning roller, and an auger.

18 Claims, 6 Drawing Sheets

| CLEANER TYPE | PRETREATMENT | RELEASE | TRANSPORT | SCAVENGE | CONVEY | COLLECTION |
|---|---|---|---|---|---|---|
| CONDUCTIVE FUR BRUSH CLEANER | LIGHT/CORONA CHARGING | MECHANICAL:<br>1) INTERFERENCE BETWEEN BRUSH AND SUBSTRATE<br>2) ROTATIONAL ENERGY FROM BRUSH INTO SUBSTRATE | MECHANICAL:<br>1) CONVEY TO SCAVENGING SITE THROUGH ROTATION OF BRUSH<br>2) PHYSICAL CAPTURE OF PARTICLE IN FIBER MATRIX<br>ELECTRICAL:<br>1)COULUMBIC ATTRACTION BETWEEN WASTE MATERIAL AND BRUSH FIBERS | MECHANICAL:<br>1) RELEASE WASTE FROM FIBER MATRIX DUE TO COLLI-SION WITH DETONE ROLLER<br>2) RELEASE WASTE FROM FIBER MATRIX DUE TO MAGNETIC FORCES BETWEEN WASTE AND MAGNETS IN DETONE ROLLER<br>ELECTRICAL:<br>1) RELEASE WASTE FROM FIBER MATRIX DUE TO GREATER COULUMBIC ATTRACTION TO DETONE ROLLER | MECHANICAL:<br>1) SKIVE PHYSICALLY REMOVES WASTE FROM DETONE ROLLER SURFACE, USE OF GRAVITY TO DISPENSE INTO AUGER TUBE | MECHANICAL:<br>1) CONVEY BY MEANS OF A WASTE BOTTLE |

FIG. 4

| CLEANER TYPE | PRETREATMENT | RELEASE | TRANSPORT | SCAVENGE | CONVEY | COLLECTION |
|---|---|---|---|---|---|---|
| CONDUCTIVE FUR BRUSH CLEANER | | 1) BRUSH SUBSTRATE INTERFERENCE<br>2) BRUSH ROTATION | 1) BRUSH ROTATION<br>2)BRUSH BIAS | 1) DETONE ROLLER ROTATION<br>2) DETONE BIAS | 1) LOCAL (AT CLEANER) AUGER ROTATION | 1) MAIN AUGER ROTATION |

FIG. 5

PERFORMANCE SENSING CLEANING DEVICE

CROSS REFERENCE TO RELATED APPLICATION

Reference is made to and priority claimed from U.S. Provisional Application Ser. No. 60/317,392, filed Sep. 5, 2001, entitled PERFORMANCE SENSING CLEANING DEVICE.

BACKGROUND OF THE INVENTION

1. Field of the Invention

The present invention relates in general to a performance rating device in a cleaning assembly, and more particularly to an apparatus that monitors the performance of a cleaner for an electrophotographic image processing device by monitoring whether all rotational and biasing devices are operating properly, and whether the cleaner is in correct geometric orientation with respect to a substrate being cleaned.

2. Description of the Related Art

In a typical commercial reproduction apparatus or image processing apparatus (electrostatographic copier/duplicators, printers, or the like), a latent image charge pattern is formed on a uniformly charged dielectric member. Pigmented marking particles are attracted to the latent image charge pattern to develop such images on the dielectric member. A receiver member is then brought into contact with the dielectric member. An electric field provided by a met corona charger or an electrically biased roller, is applied to transfer the marking particle developed image to the receiver member from the dielectric member. After transfer, the receiver member bearing the transferred image is separated from the dielectric member and transported away from the dielectric member to a fuser apparatus at a downstream location. There, the image is fixed to the receiver member by heat and/or pressure from the fuser apparatus to form a permanent reproduction thereon.

However, not all of the marking particles are transferred to the receiver member and some remain upon the dielectric member that may include belts or a drum. Therefore, a cleaning assembly is commonly used to remove the excess marking particles. The cleaning assembly usually includes an electrostatic cleaning brush (detoning roller), a skive, and a receptacle to hold the excess marking particles (waste toner material). The elements within the cleaning assembly generally rotate to remove waste particles.

It is important to determine whether the cleaning assembly is operating properly to avoid contamination of the entire image processing apparatus. However, it is difficult to measure the performance of the cleaning assembly. For example, conventional cleaning assembly performance measurements are made using a sophisticated sensor which detects the number of particles remaining on a substrate after the substrate has passed by the cleaning assembly. In conventional structures, measurement of cleaning effectiveness by use of transmission or reflection densitometry of the substrate has a number of disadvantages: First the sensor(s) themselves can be contaminated and a source of reliability degradation. Also these sensors are generally only effective at the detection of catastrophic failures due to the low sensitivity of these sensors. Further, these sensors are generally of high cost, and use of these sensors do not provide any additional information as to the root cause of the cleaning failure. The invention senses the important attributes of the cleaning function and is much more effective than conventional systems that simply measure the effectiveness of the cleaning function.

SUMMARY OF THE INVENTION

In view of the foregoing and other problems, disadvantages, and drawbacks of the conventional cleaning assembly the present invention has been devised, and it is an object of the present invention, to provide a structure and method for an improved cleaning assembly.

In order to attain the object suggested above, there is provided, according to one aspect of the invention, an image processing apparatus that includes an image transfer substrate, a cleaner adjacent the substrate, and sensors within the cleaner. The cleaner removes contaminates from the substrate. The sensors detect a position of the cleaner with respect to the substrate, a proper rotation of components within the cleaner, and a proper bias of the components. If the sensors detect an improper position, an improper rotation, or an improper bias, the cleaner is rated unacceptable.

The components include a fiber brush, a detoning roller, and an auger. The fiber brush and the detoning roller are electrically biased to attract the contaminates. The invention includes a skive adapted to remove the contaminates from the detoning roller. The auger transports the contaminates to a storage receptacle after the skive removes the contaminates from the detoning roller. The sensors eliminate the need for sensors associated with the substrate.

The invention provides an image transfer substrate and places a cleaner adjacent the substrate with sensors within the cleaner. The invention removes contaminates from the substrate with the cleaner. The invention detects, with the sensors, a relative position of the cleaner with respect to the substrate. The invention also detects a proper rotation of components with respect to the substrate. Further, the invention detects a proper bias of the components. The cleaner is rated unacceptable if the sensors detect an improper position, an improper rotation, or an improper bias. The invention also detects whether components, including a fiber brush, a detoning roller, and an auger, are rotating properly. The fiber brush and the detoning roller are biased to attract the contaminates.

Therefore, the invention checks the cleaning function by sensing the operation of the subsystems (e.g., release, transport, scavenge, convey, collection) within the cleaning assembly. Thus, the invention checks the rotation of the brush, detoning roller, auger(s). In addition, the invention checks for brush and detone bias voltage. Further, a sensor is used to detect proper spacing and orientation between the cleaner and the substrate. By observing the foregoing features, the invention does not require sophisticated sensors associated with the substrate to measure the effectiveness of the actual cleaning function.

BRIEF DESCRIPTION OF THE DRAWINGS

The foregoing and other objects, aspects and advantages of the invention will be better understood from the following detailed description of preferred embodiment of the invention with reference to the drawings, in which:

FIG. 4 is a chart showing the construction of different elements within the cleaning assembly; and FIG. 5 is a chart showing the different features that the invention monitors to rate the performance of the cleaning assembly.

DETAILED DESCRIPTION OF PREFERRED EMBODIMENTS OF THE INVENTION

Figure 1:
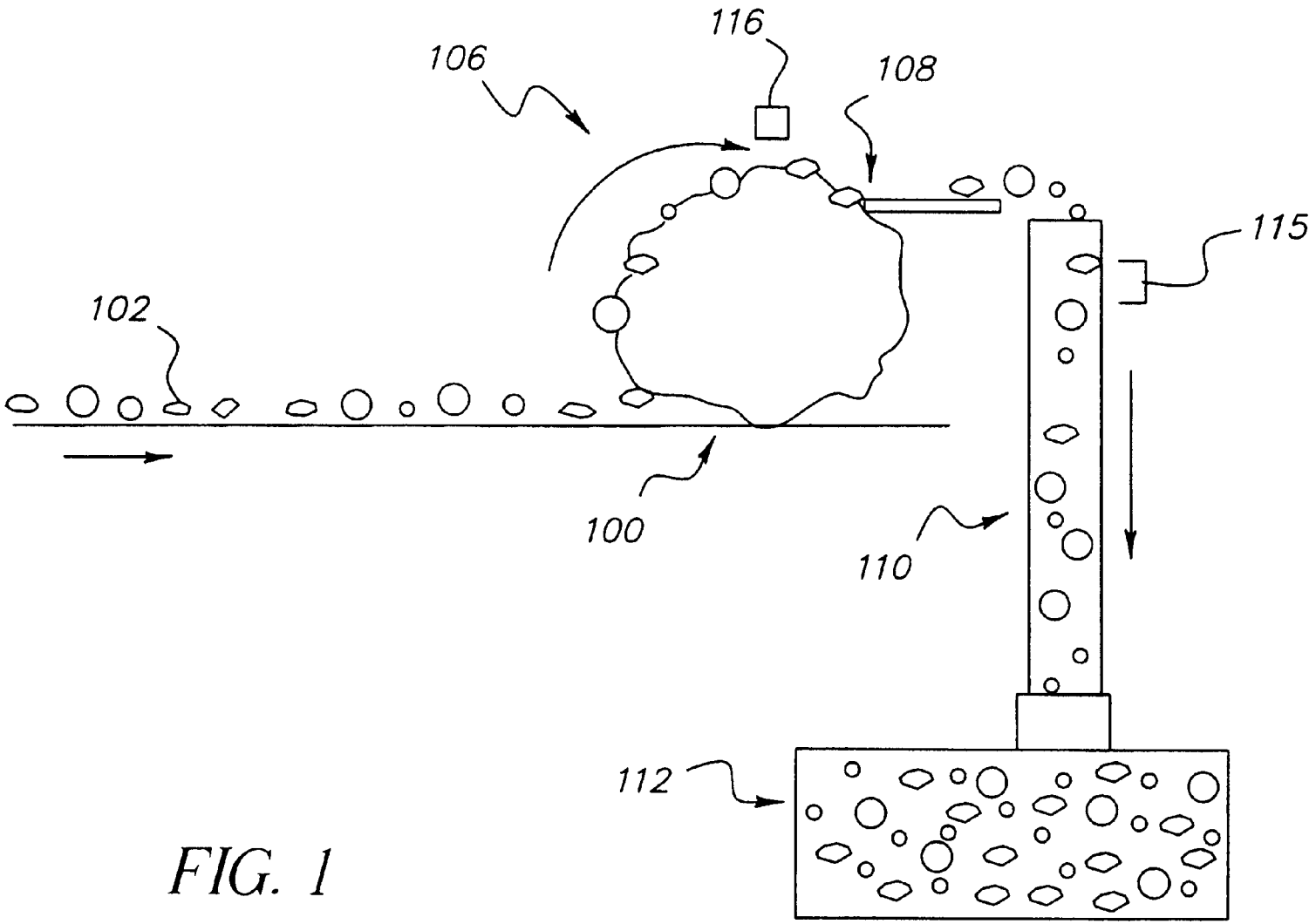
FIG. 1 is a schematic drawing showing the fundamental components of most cleaning assemblies.

The invention overcomes the problems discussed above regarding the difficulty of rating the performance of a cleaning assembly. FIG. 1 illustrates a conceptual drawing of the different elements within a cleaning assembly. A substrate 100 that is to be cleaned is illustrated as having waste particles 102 thereon. These waste particles 102 are undesirable contamination on the substrate 100 and should be removed.

As shown in FIG. 4, there are a number of different cleaner types that are used, such as a conductive brush cleaner. As is also shown in FIG. 4, the pretreatment can comprise the application of light or a corona charging procedure.

The waste particles are transferred from the substrate 100 into a collection media 106. The waste particles 102 are collected by the collection media 106 because of physical and electrical characteristics. For example, the collection media 106 can comprise a fiber brush in combination with a vacuum, a magnetic brush, or a conductive fur brush. In a preferred embodiment, the collection media 106 rotates as indicated by the arrow in FIG. 1. As shown in FIG. 4, the release from the substrate 100 to the collection media 106 occurs because of mechanical energy being transferred to the waste particles 102 from rotation of the collection media 106. In addition, the waste particles 102 are electrically attracted to the collection media 106. Therefore, the collection media 106 performs the function of releasing the waste particles 102 from the substrate 100, and transporting the waste particles 102 as the collection media 106 rotates (which is performed using mechanical and electrical forces, see FIG. 4).

The invention scavenges the waste particles 102 transferred from the collection media 106. The effectiveness of the collection media 106 at entraining the waste particles 102 decreases as the amount of collected waste increases. Therefore, a scavenging system 108 (such as an electrically biased detone roller in conjunction with a mechanical skive blade) is used to remove the waste particles 102 from the collection media 106. The scavenging system 108 causes the waste particles 102 to be directed into a tube, such as an auger tube 110. The auger tube 110 transports the waste particles 102 into a collection chamber 112.

Figure 2A:
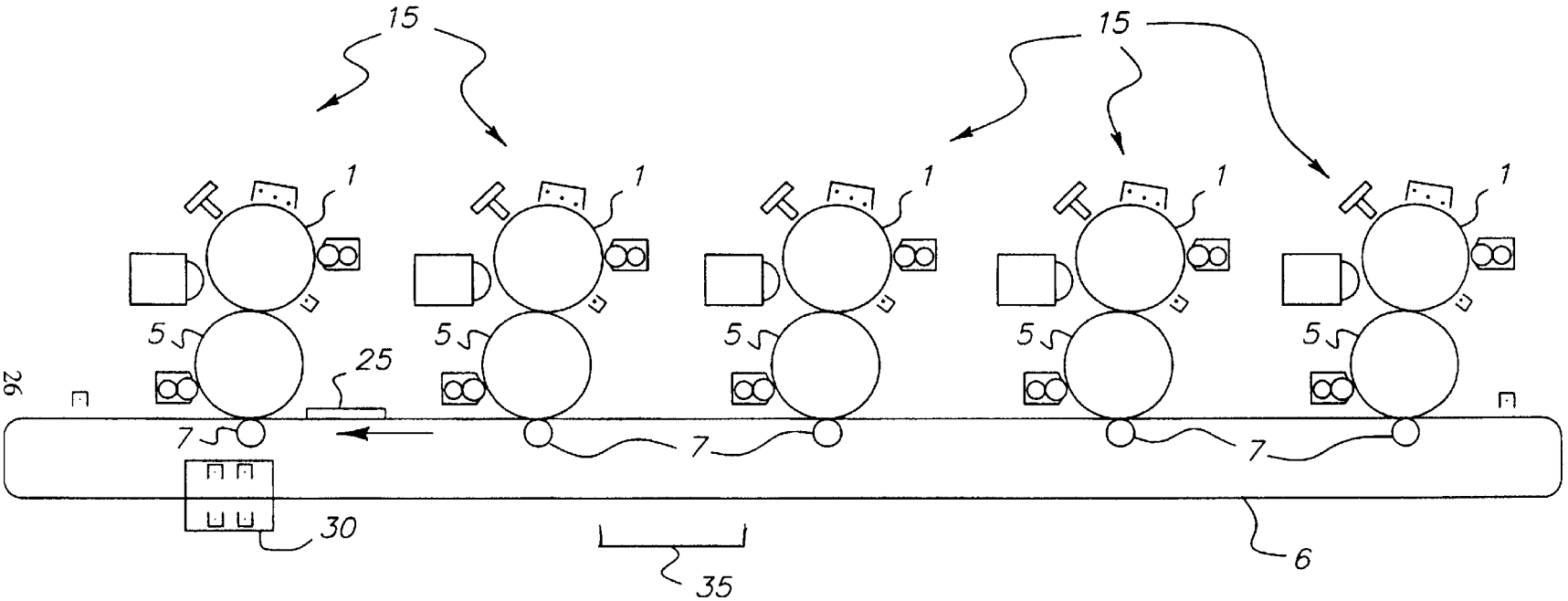
FIGS. 2A and 2B are side elevation schematics of a color printer apparatus utilizing a cleaning apparatus of the invention.
Figure 2B:
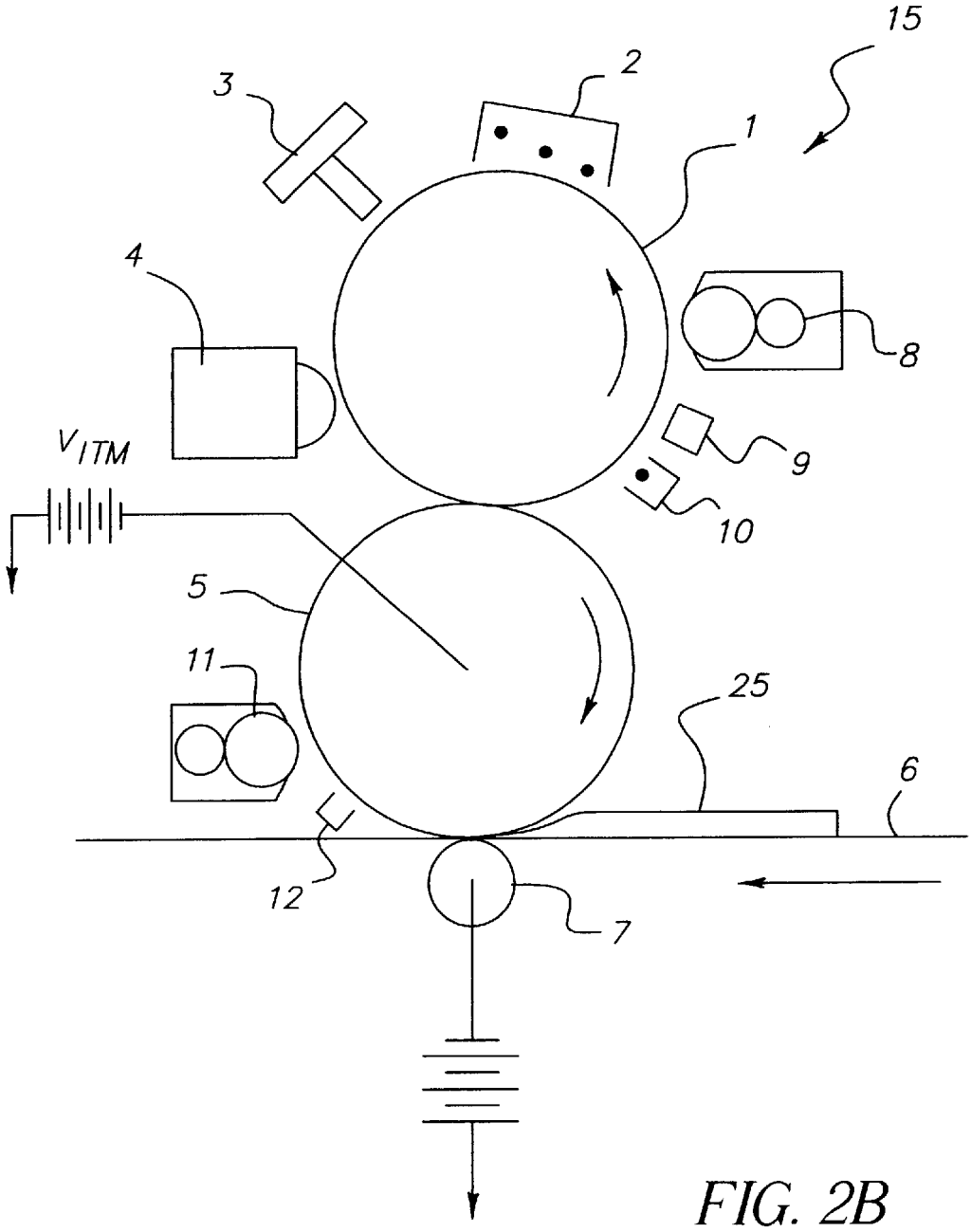

FIG. 2A illustrates an apparatus in which the invention may be used. A conveyor 6 is drivable to move a receiving sheet 25 (e.g., paper, plastic) past a series of imaging stations 15. One of the imaging stations 15 is shown in greater detail in FIG. 2B.

With the invention, a primary image member (for example a photoconductive drum) 1 within each imaging station 15 is initially charged by a primary charging station 2. This charge is then modified by a printhead 3 (e.g., LED printhead) to create an electrostatic image on the primary image member 1. A development station 4 deposits toner on the primary image member 1 to form a toner image corresponding to the color of toner in each individual imaging station 15. The toner image is electrostatically transferred from the primary image member 1 to an intermediate transfer member, for example, intermediate transfer roller or drum 5. While both the primary image member 1 and the intermediate transfer member 5 are shown as drums, as would be known by one ordinarily skilled in the art, these could also comprise belts or similar image transfer surfaces. The drums 1, 5 are used in these examples to simplify the explanation of the invention; however, the invention is not limited to drums, but instead, is applicable to all similar structures/surfaces.

Figure 3:
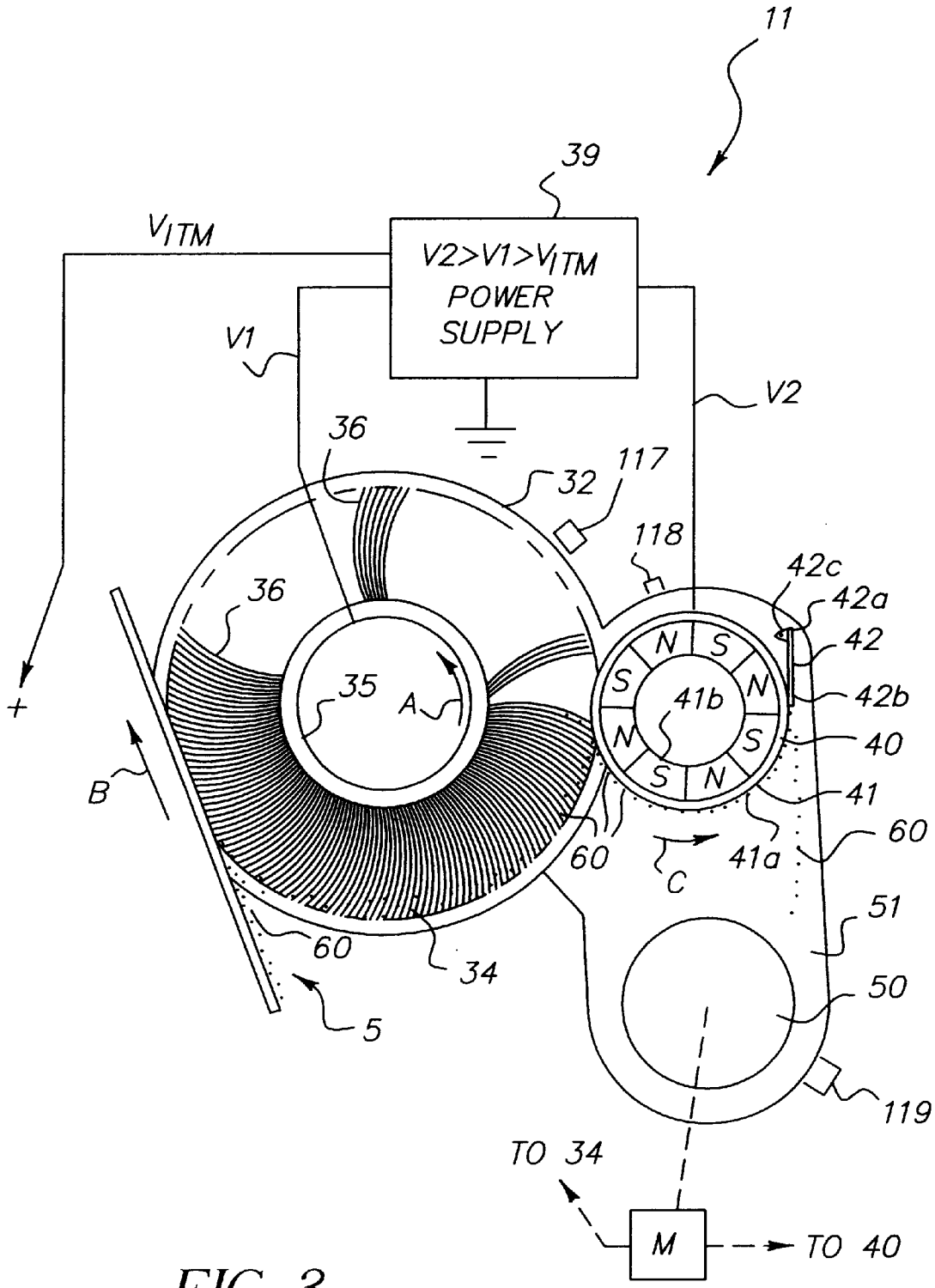
FIG. 3 is a side elevation schematic showing in greater detail the leaning apparatus forming a part of the apparatus of FIG. 2.

After the charged toner is transferred to the intermediate transfer drum 5, there still remains some waste toner particles that need to be removed from the primary image member 1. The invention uses a pre-cleaning erase light emitting diode (LED) lamp 9 in combination with a pre-cleaning charging station 10 in order to electrostatically modify the surface potential of the non-image areas of the primary image member 1 and the charge on the waste toner remaining on the primary image member 1, respectively. In addition, a cleaning station 8 is included to physically remove any remaining waste toner particles. The cleaning station 8 is illustrated in FIG. 3 and is discussed in greater detail below.

A transfer nip is used between a transfer backer roller 7 and the intermediate transfer drum 5 to transfer the toner image to the receiver sheet 25. In a similar manner to that discussed above, the remaining waste toner particles that remain on the intermediate transfer drum 5 after the toner has been transferred to the receiver sheet 25 are removed using a pre-cleaning charging station 12 and a cleaning station 11. Once again, the details of the cleaning station 11 are shown in FIG. 3 and are discussed below in detail. The receiver sheet 25 is transported by the conveyor 6 to a fuser 30 where the toner image is fixed by conventional means. The receiver sheet 25 is then conveyed from the fuser 30 to an output tray 35.

The toner image is transferred from the primary image member 1 to the intermediate transfer drum 5 in response to an electric field applied between the core of the intermediate transfer drum 5 and a conductive electrode forming a part of the primary image member 1. The toner image is transferred to the receiver sheet 25 at the nip in response to an electric field created between the transfer backer roller 7 and the intermediate transfer drum 5. Thus, intermediate transfer drum 5 helps establish both electric fields. As is known in the art, a polyurethane roller containing an appropriate amount of anti-static material to make it of at least intermediate electrical conductivity can be used for establishing both fields. Typically, the polyurethane or other elastomer is a relatively thick layer; e.g., one-quarter inch thick, which has been formed on an aluminum base.

Preferably, the electrode buried in the primary image member 1 is grounded for convenience in cooperating with the other stations in forming the electrostatic and toner images. If the toner is a positively-charged toner, an electrical bias $V_{ITM}$ applied to intermediate transfer drum 5 of typically −300 to −1,500 volts will effect substantial transfer of toner images to intermediate transfer drum 5. To then transfer the toner image onto a receiver sheet 25, a bias, e.g., of −2,000 volts or greater negative voltages, is applied to transfer backer roller 7 to again urge the positively-charged toner to transfer to the receiver sheet 25. Schemes are also known in the art for changing the bias on intermediate transfer drum 5 between the two transfer locations so that transfer backer roller 7 need not be at such a high potential.

The intermediate transfer drum 5 has a polyurethane base layer upon which a thin skin is coated or otherwise formed having the desired release characteristics. The polyurethane base layer preferably is supported upon an aluminum core. The thin skin may be a thermoplastic and should be relatively hard, preferably having a Young's modulus in excess of $5^* 10^7$ Newtons per square meter to facilitate release of the toner to ordinary paper or another type of receiver sheet 25. The base layer is preferably compliant and has a Young's modulus of $10^7$ Newtons per square meter or less to assure good compliance for each transfer.

With reference also now to FIG. 3, the cleaning station or apparatus 11 comprises a housing 32 which encloses a cleaning brush 34 having conductive fibers 36 which, through an opening in the housing, engage the intermediate transfer drum 5.

The cleaning brush 34 is supported on a core 35 which is driven to rotate by a motor M or other motive source to rotate in the direction of arrow A as the intermediate transfer drum 5 is moved in the direction shown by arrow B. As the cleaning brush 34 rotates, untransferred toner particles 60 and other particulate debris, such as carrier particles and paper dust on the intermediate transfer drum 5, are mechanically scrubbed from the intermediate transfer drum 5 and picked up into the conductive fibers 36 of the cleaning brush 34. The items illustrated in the figures are generally not shown to scale to facilitate understanding of the structure and operation of the apparatus. In particular, the conductive fibers 36 are shown much larger to scale than other structures shown in FIG. 3.

In addition to mechanical scrubbing, an electrical bias is applied to the cleaning brush 34 from power supply 39. An electrical bias V1 of the power supply 39 to the cleaning brush 34 is, as will be more fully explained below, inductively, and not conductively, coupled to the conductive fibers or brush fibers 36. A voltage V1 is greater than a voltage bias $V_{ITM}$ applied to the intermediate transfer drum 5. The polarity of the voltage on the conductive fibers 36 is such as to electrostatically attract toner 60 to the conductive fibers 36. The untransferred toner particles 60 entrained within the conductive fibers 36 are carried to a rotating detoning roller 40 which is electrically biased by power supply 39 to a higher voltage level V2 than the voltage level V1; i.e., the voltage level V2 is of a level to electrostatically attract the untransferred toner particles 60 in the cleaning brush 34 to the detoning roller 40. Assuming a positively charged toner image, as an example, the toner image may be attracted to the intermediate transfer drum 5 which is biased to the voltage bias $V_{ITM}$ in the range of from about −300 volts to about −1500 volts. The cleaning brush 34, in such an example, would be biased to a potential V1 which is in the range of from about −550 volts to about −1750 volts. The detoning roller 40 in this example would be biased to a potential V2 which is in the range of from about −800 volts to about −2000 volts. In considering relationships of voltage $V2>V1>V_{ITM}$, the absolute values of the voltages are implied.

The untransferred toner particles 60 are electrostatically attracted to the surface 41 of the detoning roller 40. The surface 41 of detoning roller 40 is rotated in the direction of arrow C by a drive force from motor M counter to that of the conductive fibers 36 or alternatively in the same direction. The untransferred toner particles 60 are carried by the surface 41 of the detoning roller 40 toward a stationary skive blade 42 which is supported as a cantilever at end 42*a* so that the scraping end 42*b* of the skive blade 42 engages the surface 41 of the 30 detoning roller 40.

The untransferred toner particles 60 scrubbed from the surface 41 are allowed to fall into a collection chamber 51 of housing 32 and periodically a drive force such as from motor M or another motive source, is provided to cause an auger 50, or another toner transport device, to feed the untransferred toner particles 60 to a waste receptacle. Alternatively, the waste receptacle may be provided, attached to housing 32, so that particles fall into the waste receptacle directly and the auger 50 may be eliminated. In order to ensure intimate contact between the detoning roller surface 41 and the skive blade 42, a permanent magnet is stationarily supported within the hollow enclosure of the detoning roller 40.

The skive blade 42 is made of a metal such as ferromagnetic steel and is of a thickness of less than 0.5 mm and is magnetically attracted by the magnet to the detoning roller surface 41. This effectively minimizes the tendency of the scraping end 42*b* to chatter as the surface 41 travels past the scraping end 42*b* and thus provides more reliable skiving of the untransferred toner particles 60 and, therefore provides, improved image reproduction. The skive blade 42 extends for the full working width of the detoning roller surface 41 and is supported at its end 42*a* by ears 42*c* which are soldered to the skive blade 42. A pin extends through a hole in the ears 42*c* to connect the skive blade 42 to the housing 32.

The detoning roller 40 preferably comprises a toning or development roller as is used in known magnetic brush-type development stations which include a core of permanent magnets surrounded by a metal sleeve 41*a*. As a detoning roller 40, the magnetic core is formed of a series of alternately arranged poles (north-south-north-south), permanent magnets 41*b* that are stationary when in operation. Sleeve 41*a* is formed of polished aluminum or stainless steel and is electrically conductive, but nonmagnetic, so as to not reduce the magnetic attraction of the skive blade 42 to the permanent magnets 41*b*. The sleeve 41*a* is driven to rotate in the direction of arrow C and is electrically connected to potential V2.

As shown in FIG. 4, the invention monitors the operation of the different subsystems within the overall cleaning apparatus 11 to monitor the cleaning apparatus performance. Therefore, the invention includes a number of sensors 115–119 (FIGS. 1 and 3) that measure the operation of the different subsystems (individual elements) within the cleaning assembly. For example, with respect to the mechanical release function, one sensor will detect the interference between the cleaning brush 34 and the substrate 100, and another sensor will detect whether rotational energy from the cleaning brush 34 is reaching the substrate 100. Similarly, with respect to the transportation function in mechanical transport, a sensor measures the conveying function to the scavenging site by checking the rotation of the cleaning brush 34, and another sensor measures the physical capture of the untransferred toner particles 60 in the fiber matrix. Also, with respect to the electrical transport, the sensors detect columbic attraction between waste material and conductive fibers 36. With respect to the scavenging function, the invention detects how much waste is released from the fiber matrix due to the collision with the detoning roller rotation, and by measuring magnetic forces between the waste and permanent magnets 41*b* in the detoning roller 40. At the convey function (FIG. 4), the invention determines whether the skive blade 42 physically removes waste from the detoning roller surface 41, as well as whether gravity dispenses the waste into the auger tube 110. Finally, with respect to the collection function, the invention determines whether the cleaner or cleaning apparatus 11 is properly conveying waste (by means of gravity/auger) using a sensor in the waste bottle 112.

As similarly shown in FIG. 5, with respect to the release function, one sensor will detect whether the cleaning brush 34 is contacting the substrate 100 and whether the cleaning brush 34 is rotating (FIG. 5). Similarly, with respect to the transportation function, the sensors detect brush rotation and brush bias. Also, with respect to the scavenging function (FIG. 5), the invention detects detoning roller rotation as well as detone bias. At the convey function (FIG. 5), the invention determines whether there is local auger rotation. Finally, with respect to the collection function, the invention determines whether there is main auger rotation.

The actual implementation of the performance sensing can be quite variable depending on the configuration of the hardware. For example, the detection of the cleaning brush 34 contacting the substrate 100 could be implemented simply as an electrical switch on the cleaning apparatus 11 that would actuate when the cleaning apparatus 11 is placed in proper geometrical orientation with respect to the substrate 100, or as complex as optical or acoustic proximity sensors that accomplish the same function. Bias detection can be implemented as a closed loop system where the electrical bias voltage of the supply 39 to the cleaning apparatus 11 is returned back to the power supply or another electrical circuit in which the electrical bias voltage is compared to the returned voltage, and errors generate when the supply and return voltages do not match (within some tolerance band). This also provides a check for the presence of the cleaning brush or conductive fur brush 34 or detoning roller 40 in the cleaning apparatus 11 in those hardware configurations that allow easy removal of those devices.

Bias detection could also be accomplished with more complex means, such as electrostatic voltage meters that measure the cleaning brush and detoning voltage levels. Rotation sensing can be accomplished by a multitude of means, ranging from standard electromechanical methods, such as cams actuating electrical switches and hall effect sensors, to purely electrical means, such as sensing the current draw of the motor(s), to electromechanical/optomechanical methods such as optical encoders or resolvers. The sensors used generally have a specific function, such as rotation sensing and sensing to detect brush engagement to the substrate 100. The bias detection sensing also has a secondary benefit of detecting the presence of either the cleaning brush or conductive fur brush 34 or the detoning roller 40.

Therefore, a proper cleaning function is determined by sensing the operation of the subsystems (e.g., release, transport, scavenge, convey, collection) within the cleaning assembly. Thus, the invention checks the rotation of the cleaning brush 34, detoning roller 40, auger(s) 50. In addition, the invention checks for cleaning brush and detoning electrical bias voltage. Further, a sensor is used to detect proper spacing and orientation between the cleaning apparatus 11 and the substrate 100. By observing the foregoing features, the invention does not require sophisticated sensors associated with the substrate 100 to measure the effectiveness of the actual cleaning function.

While the invention has been described in terms of preferred embodiments, those skilled in the art will recognize that the invention can be practiced with modification within the spirit and scope of the appended claims.

PARTS LIST

| Item | Description |
|---|---|
| 1 | primary image member |
| 2 | primary charging member |
| 3 | printhead |
| 4 | development station |
| 5 | intermediate transfer drum |
| 6 | conveyor |
| 7 | transfer backer roller |
| 8 | cleaning station |
| 9 | pre-cleaning erase LED lamp |
| 11 | cleaning station |
| 12 | charging station |
| 15 | imaging station |
| 25 | receiving sheet |
| 30 | fuser |
| 32 | housing |
| 34 | cleaning brush |
| 35 | output tray |
| 36 | fibers |
| 39 | power supply |
| 40 | detoning roller |
| 41 | detoning roller surface |
| 41a | sleeve |
| 41b | permanent magnets |
| 42 | skive blade |
| 42a | blade end |
| 50 | auger |
| 60 | toner particles |
| 100 | substrate |
| 102 | waste particles |
| 106 | collection media |
| 108 | scavenging system |
| 110 | auger tube |
| 115–119 | sensors |

What is claimed is:

1. An image processing apparatus for forming a toner image on an image transfer substrate, said apparatus comprising:

a cleaner adjacent said substrate, said cleaner including components for removing contaminates from said substrate; and sensors within said cleaner, said sensors detecting a position of said cleaner with respect to said substrate.

2. The image processing apparatus in claim 1, wherein if said sensors detect an improper position, said cleaner is rated unacceptable.

3. The image processing apparatus in claim 1, wherein said cleaner components include a rotatable fiber brush, a detoning roller, and a rotatable auger.

4. The image processing apparatus in claim 3, wherein said fiber brush and said detoning roller are electrically biased to attract contaminates.

5. The image processing apparatus in claim 3, further comprising a skive blade adapted to remove contaminates from said detoning roller.

6. The image processing apparatus in claim 5, wherein said auger transports contaminates to a storage receptacle after said skive blade removes said contaminates from said detoning roller.

7. An image processing apparatus for forming a toner image on an image transfer substrate, said apparatus comprising:

a cleaner adjacent said substrate, said cleaner including components for removing contaminates from said substrate; and sensors within said cleaner, said sensors detecting a position of said cleaner with respect to said substrate, a proper rotation of cleaner components within said cleaner, and a proper electrical bias of said components.

8. The image processing apparatus in claim 7, wherein if said sensors detect an improper position, an improper rotation of cleaner components, or an improper electrical bias to cleaner components, said cleaner is rated unacceptable.

9. The image processing apparatus in claim 7, wherein said cleaner components include a fiber brush, a detoning roller, and an auger.

10. The image processing apparatus in claim 9, wherein said fiber brush and said detoning roller are electrically biased to attract contaminates.

11. The image processing apparatus in claim 9, further comprising a skive blade adapted to remove contaminates from said detoning roller.

12. The image processing apparatus in claim 11, wherein said auger transports contaminates to a storage receptacle after said skive blade removes said contaminates from said detoning roller.

13. A method of image processing for forming a toner image on an image transfer substrate and cleaning such image transfer substrate of waste toner particles with a cleaning assembly having cleaner components, said method comprising the steps of:

placing a cleaning assembly adjacent said image transfer substrate;

removing contaminates from said substrate with the components of the cleaning assembly; and detecting, with sensors in the cleaning assembly, a relative position of the cleaning assembly with respect to the image transfer.

14. The method of claim 13, wherein said detecting step further comprises detecting a proper rotation of cleaner components with respect to said substrate.

15. The method of claim 14, wherein said detecting step further comprises detecting a proper electrical bias of said cleaner components.

16. The method of claim 15, wherein if said sensors detect an improper position of cleaner components, an improper rotation of cleaner components, or an improper electrical bias to cleaner components, said cleaner is rated unacceptable.

17. A method of image processing for forming a toner image on an image transfer substrate and cleaning such image transfer substrate of waste toner particles with a cleaning assembly having cleaner components, said method comprising the steps of:

placing a cleaning assembly adjacent said image transfer substrate;

removing contaminates from said substrate with the components of the cleaning assembly; and detecting with sensors in the cleaning assembly, a relative position of the cleaning assembly with respect to the image transfer substrate, and a proper electrical bias of said components.

18. The method of claim 17, wherein if said sensors detect an improper position of cleaner components, an improper rotation of cleaner components, or an improper electrical bias to cleaner components, said cleaner is rated unacceptable.

* * * * *